US006540302B1

(12) United States Patent
Crocker et al.

(10) Patent No.: US 6,540,302 B1
(45) Date of Patent: Apr. 1, 2003

(54) CHAIR HAVING A LUMBAR SUPPORTING REMOVABLE BACK

(75) Inventors: Charles S Crocker, Cornwall (GB); Ben Hayden, Cornwall (GB)

(73) Assignee: Stadium Products International Ltd., Bodmin (GB)

( * ) Notice: Subject to any disclaimer, the term of this patent is extended or adjusted under 35 U.S.C. 154(b) by 0 days.

(21) Appl. No.: 09/722,879

(22) Filed: Nov. 27, 2000

Related U.S. Application Data

(63) Continuation of application No. 09/216,296, filed on Dec. 18, 1998, now abandoned.

(30) Foreign Application Priority Data

Dec. 18, 1997 (GB) ..... 9726633
Aug. 28, 1998 (GB) ..... 9818702

(51) Int. Cl.[7] ..... A47C 7/02

(52) U.S. Cl. ..... 297/452.31; 297/440.21; 297/181

(58) Field of Search ..... 297/55, 440.21, 297/440.11, 440.2, 181, 188.3, 218.4, 452.2, 452.29, 452.3, 452.31; D6/345, 358, 359, 501, 502, 597, 599, 611

(56) References Cited

U.S. PATENT DOCUMENTS 2,281,902 A * 5/1942 Witz ..... 297/440.21
3,724,897 A * 4/1973 Faiks et al. ..... 297/446
5,649,742 A * 7/1997 Liu ..... 297/452.2
5,961,184 A * 10/1999 Balderi et al. ..... 297/448.1

FOREIGN PATENT DOCUMENTS

FR 1333869 A * 6/1963 ..... 297/252.2
FR 001532516 A * 6/1968 ..... 297/440.16

* cited by examiner

*Primary Examiner*—Jose V. Chen
*Assistant Examiner*—Jerry A. Anderson
(74) *Attorney, Agent, or Firm*—Darby & Darby

(57) ABSTRACT

An article, particularly of furniture, such as a chair, at least a portion of which is shaped and decorated whereby to simulate an equivalent article having a fabric article such as a shirt arranged over it. The simulation may be achieved by the shape of the portion and/or the texture of its surface and/or surface decoration. A lower part of the chair back is formed as a suspended flap to provide flexible support of the lumbar region of a person sitting on the chair.

14 Claims, 2 Drawing Sheets

CHAIR HAVING A LUMBAR SUPPORTING REMOVABLE BACK

This is a continuation of application Ser. No. 09/216,296, filed Dec. 18, 1998, now abandoned.

BACKGROUND OF THE INVENTION

The present invention relates generally, but not exclusively, to an article of furniture.

In a stadium, where large numbers of identical items of furniture such as chairs, are provided, it is usual for there to be made with a tipping seat to enable spectators to walk along the rows to reach a particular numbered seat.

Sporting events, such as baseball or football involving two teams often have areas of the stadium set aside for the supporters of one or other of the teams. Until now the seating for spectators supporting one team has been indistinguishable from that for spectators supporting the other team and no distinction can be made between them.

SUMMARY OF THE INVENTION

The present invention provides an article, particularly an article of furniture, at least a portion of which is shaped and decorated whereby to provide a simulation of an article having a fabric article arranged over it. The simulation may, for example, be achieved by the shape of the said portion and/or the texture of its surface and/or its surface decoration. The fabric article to be simulated may be, but not necessarily, of textile or other relatively thin, supple material usable for garments and furnishing purposes.

The article may be part of an item of furniture or may be a complete item of furniture over which it is customary to place a fabric article; examples include a towel rail, a coat stand, a table top or a chair back, which might be covered with a cloth. The fabric article simulated may thus be a generally flat article which may look as if it is hanging in folds on its support, or a three-dimensional garment which holds its own shape or conforms to the shape of the body or object over which it is placed. An article made in accordance with the invention may thus comprise, for example, a chair back having a dependant flap or flaps simulating a shirt hanging over it; such an article may conveniently be moulded integrally from plastics material, the clothing-simulating portion having a textured surface simulating a woven fabric and/or bearing a design such as those used on garments such as shirts or t-shirts.

The dependent flap or flaps simulating a shirt also has the property of offering a large flexible area in the region of the lower back to provide additional lumbar support which, because it is only supported at an upper edge, provides a high degree of comfort for the user.

In a preferred embodiment of the invention the article comprises a chair back adapted to simulate an equivalent back over which a garment has been hung. The chair back preferably comprises or includes a panel of plastics material or other suitable material, such as wood, plywood or sheet metal, which can be cut, shaped or moulded to the required form and/or on which an image of the fabric article can be formed or applied. Whatever the material used, the front face of the chair back against which the sitter rests in preferably flat or smoothly curved, that is, having the normal shaping for chair back so as not to have any protuberances which might cause discomfort to the user. Any fabric simulation on the front face of the chair back is thus preferably in the form of a generally two-dimensional representation of the three-dimensional garment being simulated in a "trompe l'oeil" fashion. The rear face of the chair back may, on the other hand, be formed or provided with a two- or three-dimensional representation of the article, the back panel optionally being extended beyond the normal extent of backrests to provide for any extension of the garment being simulated beyond the backrest.

Features and characteristics of the invention will become more clearly apparent from a consideration of the detailed description made with reference to the accompanying drawings and provided without limitation to the invention defined in the appended claim.

DESCRIPTION OF THE PREFERRED EMBODIMENT

Figure 1:
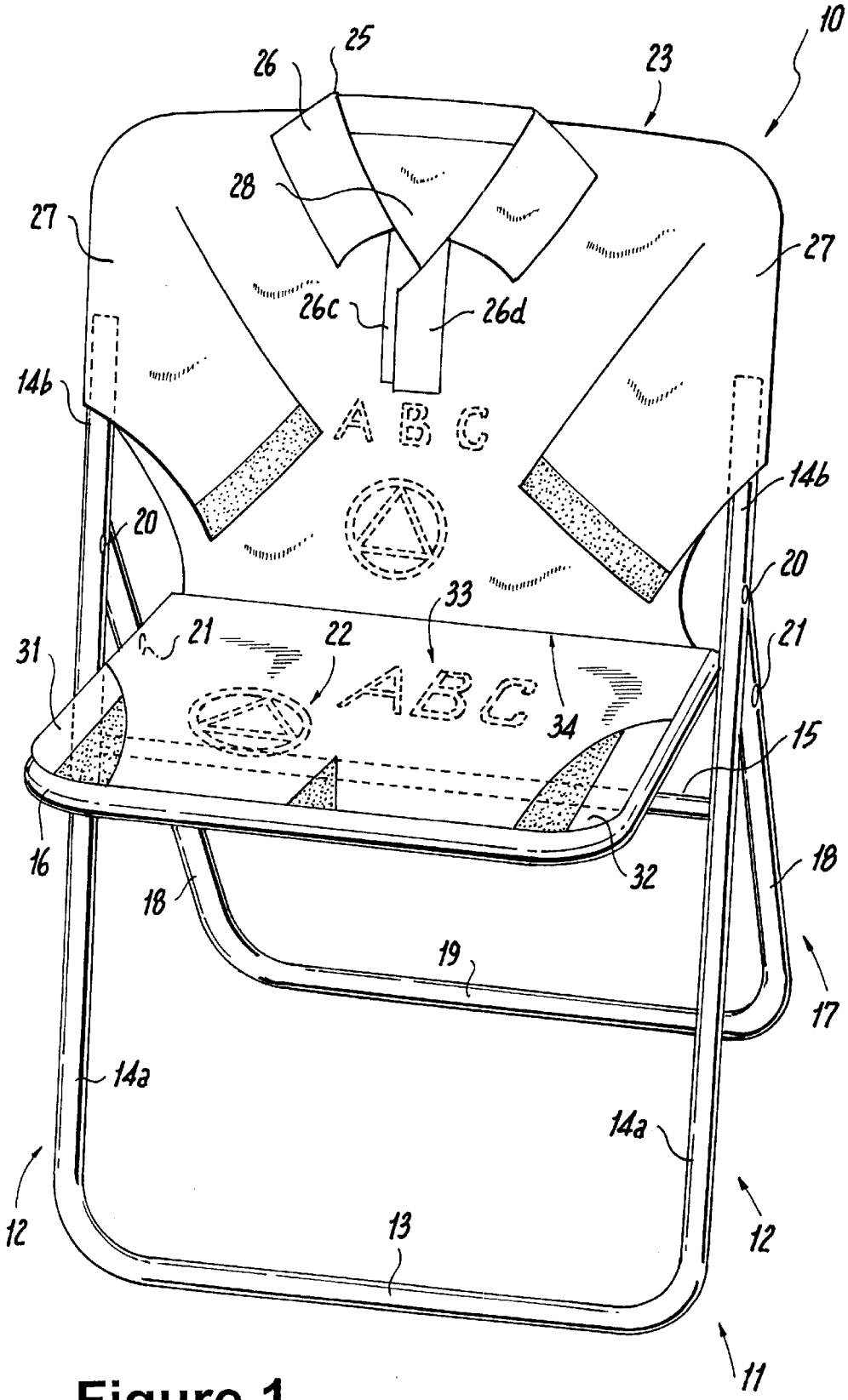
FIG. 1 is a perspective view of a chair with a simulated shirt on the back according to the invention.

With reference to FIG. 1, a collapsible, tubular-frame chair generally indicated 10 is shown in its position of use. The chair 10 includes a front or main U-shape frame generally indicated 11, comprising two limbs 12 joined at their lower ends by a rectilinear bight portion 13 which rests on the ground. Each limb 12 comprises a lower portion 14*a* and an upper portion 14*b*. The two limbs 12 are further joined by an interconnecting strut 15.

The chair 10 further includes a rear or secondary U-shape frame generally indicated 17, comprising two limbs 18 joined at their lower ends by a rectilinear bight portion 19 which rests on the ground. The rear U-shape frame 17 is pivotally connected to the front U-shape frame 11 by pivot pins 20.

The chair 10 further includes a rectangular seat frame 16 which is pivotally connected to the rear U-shape frame 17 near to the upper ends of the limbs 18 by pivot pins 21, and rests on, and is in part supported by, the interconnecting strut 15.

The pivot pins 20 and 21 hold the frames 11, 16, 17 together so as to be erectable from a collapsed position (not shown), in which the frames lie alongside each other, to an erected condition as shown in FIG. 1.

The rectangular seat frame 16 supports a panel 22 constituting the seat of the chair 10, which may be a sheet of plastics or metal or other suitable material.

The upper portions 14*b* of the limbs 12 of the front U-shape frame 11 support a backrest panel generally indicated 23, which may be a laminar element of plastics or metal or other suitable material.

Figure 2:
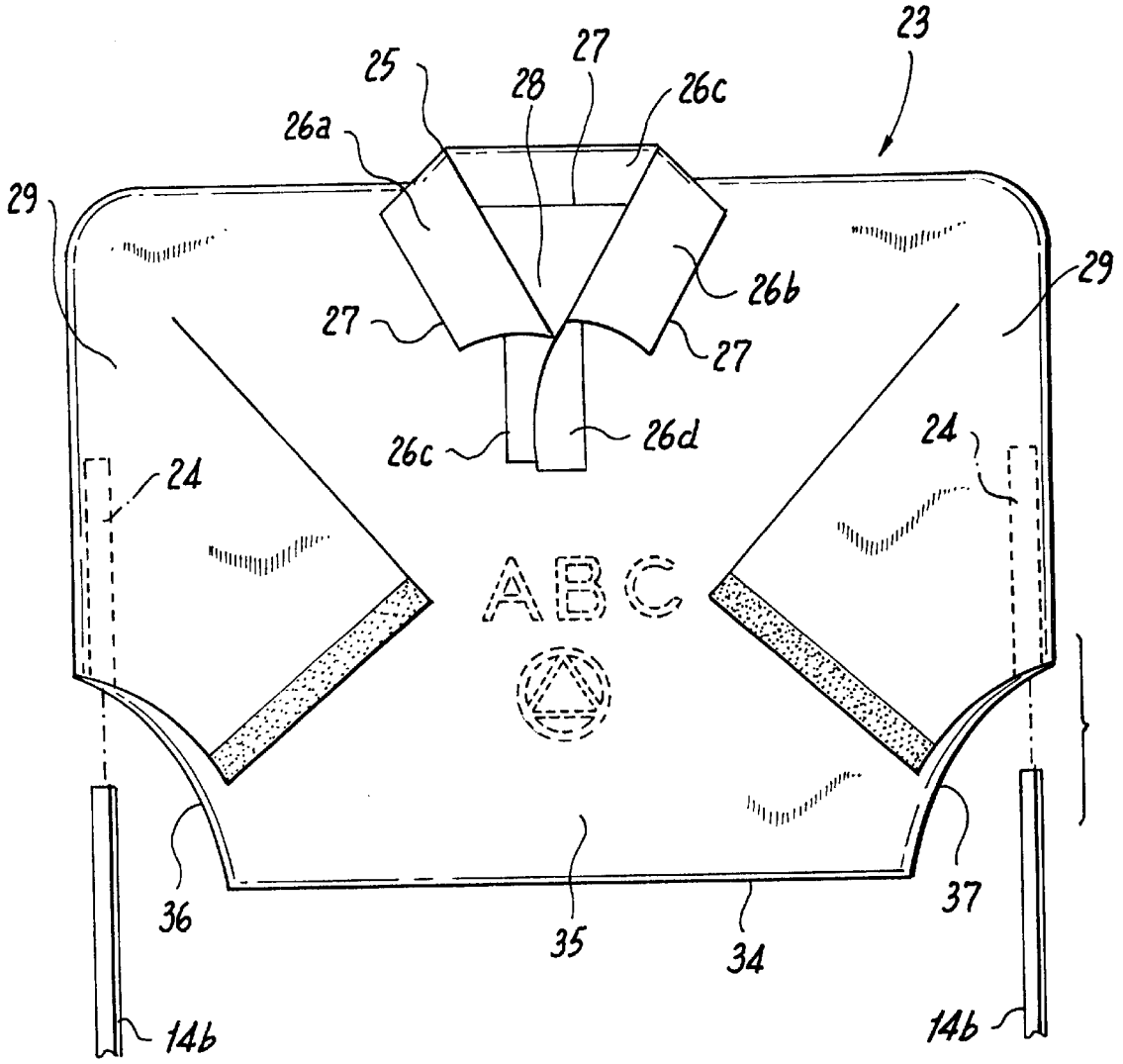
FIG. 2 is a front view of the chair back shown in FIG. 1.

The backrest panel 23 is releasably connected to the upper portions 14*b* of the limbs 12 of the front U-shape frame 11 by sockets 24 in the lateral edges thereof (see FIG. 2), so as to be easily removable for substitution by other such backrest panels, as will be described below with reference to FIG. 2.

The outline shape of the backrest panel 23 includes a downwardly projecting that portion 35 defined by a lower edge 34 and two arcuate lower side edges 36, 37. This flap portion is generally capable of flexing to provide a comfortable support for the lower lumbar region of a user.

The backrest 23 is printed with an image representing a shirt and its overall outline shape is such as to lend itself to a simulation of a shirt. The line defining the top of the upper edge of the backrest 23 has a projecting portion 25 protruding from the central region, and as will be explained in more detail below, is printed in such a way as to contribute to a simulation of a collar. This simulation comprises a combination of the shape of the projection 25 and an image of a collar represented by three generally trapezoidal areas 26*a*, 26*b*, and 26*c*, which in the monochromatic representation illustrated in the drawings appended hereto are bounded by outlines 27.

In embodiments of the invention printed in colour these areas 26*a*, 26*b* and 26*c* may be printed in a different colour from that of the remaining area of the backrest 23. The three generally trapezoidal areas 26*a*, 26*b* and 26*c* surround and define a generally triangular area 28 which represents and simulates the inside face of the back of the shirt represented by the image printed on the front of the backrest 23. For this purpose the generally triangular area 28 may be printed with a paler shade of the same or similar colour to the remaining area of the backrest 23. The generally trapezoidal area 26*c* which occupies the majority of the area of the projection 25 may likewise be printed with a paler shade of the same or a similar colour to the other two generally trapezoidal areas 26*a* and 26*b* which represent the reverse of the shirt collar, and may, for example, be printed with a contrasting colour from that of the main body of the backrest 23 which represents the main body of the shirt. Some or all of the backrest may have a surface texture representing woven fabric.

The backrest 23 is further shaped as described above by a tapering of its width towards the bottom of the panel to provide a flap 35 which represents the lower body of a shirt. This printed with areas 29 extending from the upper corners downwardly and inwardly towards the bottom 34 of the backrest 23, to represent sleeves of the shirt. In this embodiment the central portion of the backrest 23 also carries lettering and a logo for identification and/or advertising purposes.

The lower edge 34 of the backrest 23 can be positioned such as to engage against the rear edge of the seat panel 22 to assist in holding the chair in its erected condition as shown in FIG. 1. This, however, is not an essential requirement and the lower edge 34 may in other embodiments be spaced from the seat 22 when the chair is in the erected condition in order to give even greater flexibility and lumbar support.

The back face (not shown) of the backrest 23 may be plain or may carry an image of the back of the shirt or, indeed, the same image as the front or an image of a different article. The images may be printed, as indicated above, or formed in other ways, such as within the weave of a textile which is then attached such as by gluing to the face of the backrest 23. On its back face (not shown) the backrest 23 may have a three-dimensional applied or integrally moulded image. Additionally fabric may depend from the backrest 23 beneath the level of the seat panel 22 of the chair 10 to simulate a longer garment draped over the backrest 23.

As shown in FIG. 1 the seat 22 may itself be provided with a complementary simulation representing, in this example, a pair of shorts, by printing areas such as 31 and 32 with a different colour from the rest of the seat 22. Similarly other patterns or advertising material may be printed on the main central region 33 of the seat panel 22.

In order to improve the simulation and enhance the "trompe l'oeil" effect, certain areas of the seat back panel 27 and/or the seat 22 itself may be formed in low relief to stand out from the general plane defined by the rest of the panel. This may apply to the collar region 26*a*, 26*b* or the placket regions 26*c*, 26*d* and/or the regions 29 which represent the sleeves. These regions may also be formed with a different surface texture from the rest of the panel to enhance the simulation effect.

What is claimed is:

1. A chair comprising:

a chair back removably attachable to a chair frame having two upwardly projecting supports, said chair back being attachable to the chair frame at an upper region thereof and having two laterally spaced attachment parts in the form of downwardly open sockets, said sockets receiving said upwardly projecting supports when said chair back is fitted to said chair frame, said chair back having a lower dependent flap portion projecting downward between said two laterally spaced attachments parts and terminating in a lower unsupported edge region, said lower dependent flap portion being effective to provide flexible lumbar support for a lower lumbar region of a user when said chair back is attached to said chair frame, said lower dependent flap portion tapers inwardly towards said lower unsupported edge region thereof;

at least a portion of said chair back provides a visual representation that said chair back has a shirt arranged thereover with said lower dependent flap section of said chair back representing a lower part of said shirt.

2. A chair back according to claim 1, wherein the representation is achieved by the shape, the surface texture and the surface decoration of the portion.

3. A chair back according to claim 1, wherein an upper edge of the chair back has an upstanding projection which forms part of a collar of the shirt.

4. A chair back according to claim 1, wherein the chair back is embossed to provide an area in relief to represent at least one of arms, a collar and a collar placket portion of the shirt.

5. A chair comprising:

A chair back removably attachable to a chair frame having two upwardly projecting supports, said chair back being attachable to the chair frame at an upper region thereof and having two laterally spaced attachment parts in the form of downwardly open sockets, said sockets receiving said upwardly projecting supports when said chair back is fitted to said chair frame, said chair back having a lower dependent flap section projecting downward between said two laterally spaced attachment parts and terminating in a lower unsupported edge region, said lower dependent flap section being effective to provide flexible lumbar support for a lower lumbar region of a user when said chair back is attached to said chair frame, said lower dependent flap section tapers inwardly towards said lower unsupported edge region thereof.

6. A chair comprising:

a frame having two upwardly projecting supports;

a seat back attached to said frame, said seat back having two downwardly open sockets in which said upwardly projecting supports engage;

a lower dependent portion of said seat back extends downward below a point at which said seat back is attached to said frame said lower dependent flap portion having an unsupported lower edge region, said lower dependent flap portion tapering downwardly towards said unsupported lower edge region;

said lower dependent flap portion providing augmented support to a lower lumbar region of a user when sitting on said chair.

7. A chair comprising:

a frame having two upwardly projecting supports;

a seat back attached to said frame, said seat back having two downwardly open sockets in which said upwardly projecting supports engage;

a lower dependent flap portion of said seat back extends downward below a point at which said seat back is attached to said frame, said lower dependent flap portion having an unsupported lower edge region, said lower dependent flap portion tapering downwardly towards said unsupported lower edge region;

said lower dependent flap portion providing augmented support to a lower lumbar region of a user when sitting on said chair; and said seat back provides a representation of a fabric article draped thereover with said lower dependent flap portion representing a lower part of said fabric article.

8. A chair according to claim 7, wherein the seat back is removably mounted on the frame of the chair to permit exchange with similarly shaped seat backs having different simulated images thereon.

9. A chair according to claim 7, wherein the seat back is embossed to provide an area in relief to represent at least one of arms, a collar and a collar placket portion of a shirt.

10. A chair according to claim 9, wherein said seat back is removably mounted on the frame of the chair to permit exchange with similarly shaped seat backs having different simulated images thereon.

11. A chair according to claim 7 wherein the visual representation of a fabric article is a representation of a shirt arranged on the seat back of the chair.

12. A chair according to claim 11, wherein the upper edge of the seat back has an upstanding projection which forms part of a collar of the shirt.

13. A chair according to claim 7, wherein a seat portion of the chair is provided with an image representing a pair of shorts.

14. A chair according to claim 13, wherein said seat back is embossed to provide an area in relief to represent at least one of arms, a collar and a collar placket portion of a shirt.

* * * * *